United States Patent [19]

Reynard

[11] Patent Number: 4,690,442

[45] Date of Patent: Sep. 1, 1987

[54] LOCATION MEANS FOR FREIGHT CONTAINER DOOR LOCKING ASSEMBLIES

[75] Inventor: Kenneth Reynard, Thirsk, United Kingdom

[73] Assignee: George Blair Public Limited Company, England

[21] Appl. No.: 803,572

[22] Filed: Dec. 2, 1985

[30] Foreign Application Priority Data

Dec. 3, 1984 [GB] United Kingdom ..... 8430474

[51] Int. Cl.[4] ..... E05C 9/08

[52] U.S. Cl. ..... 292/218; 292/DIG. 32

[58] Field of Search ..... 292/218, DIG. 32; 248/424, 73, 65

[56] References Cited

U.S. PATENT DOCUMENTS

| | | | |
|---|---|---|---|
| 2,297,007 | 9/1942 | Lounsbury | 292/DIG. 32 X |
| 3,451,705 | 6/1969 | Turpen | 292/218 |
| 3,484,127 | 12/1969 | Pastva | 292/218 |
| 3,756,671 | 9/1973 | White | 292/218 X |
| 3,917,328 | 11/1975 | DeFilippi | 292/DIG. 32 X |
| 4,068,409 | 1/1978 | White | 292/218 X |

*Primary Examiner*—Richard E. Moore

*Attorney, Agent, or Firm*—Abelman, Frayne, Rezac & Schwab

[57] ABSTRACT

Means for locating door locking assemblies of freight containers comprises a backing member including a portion of generally plate-like form adapted to be secured, preferably by welding, to the door of the container, the front surface of the backing member being shaped to receive therein part of the circular section of the locking bar of the assembly. The means further comprises a saddle bracket having a body portion of generally U-shape to seat over the bar and to define, with the shaped front surface of the backing member, a substantially cylindrical guide channel for the locking bar. The free edges of the bracket are secured, preferably by welding, to the backing member at regions remote from the door.

3 Claims, 4 Drawing Figures

LOCATION MEANS FOR FREIGHT CONTAINER DOOR LOCKING ASSEMBLIES

BACKGROUND OF THE INVENTION

This invention relates to location means for the locking assemblies of the doors of freight containers, particularly standard dry cargo containers.

It is well established practice to lock the doors of I.S.O. containers by means of locking assemblies comprising elongate bars each mounted for controlled manual rotation about its longitudinal axis in a series of spaced location means welded to the outer surface of the door, the ends of a bar carrying cam members adapted to co-operate with associated abutment means secured to opposed members of the door frame to secure the door in said frame. Said door locking assemblies will hereinafter be referred to as 'door locking assemblies of the type described'.

The location means for the bars of door locking assemblies of the type described each commonly comprise a substantially U-shaped bracket the free edges of which are welded to the surface of the door, said bracket having an insert piece located therein the surface of which, together with the internally rounded part of the bracket itself, provides a substantially cylindrical guide channel for a bar passing through the bracket. There are typically three such brackets per locking bar, one adjacent the bottom of the bar, one adjacent the top of the bar and one intermediate the length of the bar.

For protective, anti-corrosive puposes, it is necessary to treat the metal surface of the containers in question, for example by coating them with suitable paints. Such treatment to the doors of the containers is normally carried out after the above-detailed location brackets have been welded in position. Accordingly, the areas of the door behind the brackets cannot be treated in view of the presence of said brackets, and these areas are therefore particularly prone to corrosion.

If the doors were treated prior to attachment of the brackets and said brackets were then welded in position, it will be appreciated that substantial damage to the paintwork would occur. Further, the paint film adjacent the weld area would be almost all carbon in powder form, while there would be a scorched area radiating from the weld where the resin had been burned out of the film leaving it extremely porous. Both these features lead to moisture retention. Any attempt to repaint such areas would be doomed to failure.

It has been proposed to attempt to overcome this problem by first of all treating the door and then bolting the brackets to the door by extending the sidewalls of the brackets laterally and drilling holes in the brackets and the door panel. However, as well as being expensive, water can creep through the bolt holes to create corrosion and, effectively, this solution has merely displaced the area of the container open to attack.

SUMMARY OF THE INVENTION

It is an object of the present invention to provide location means for freight container door locking assemblies of the type described which are such as not to leave any areas of the door prone to corrosion.

According to the present invention there is provided location means for freight container door locking assemblies of the type described, the location means comprising a backing member including a substantially plate-like portion adapted to be secured, preferably by welding, with its rear surface against the surface of the door of the container, the front surface of said backing member being shaped to receive therein part of the circular section of the locking bar of the assembly, and a saddle bracket having a body portion of substantially U-shape in transverse section the free edges of which are adapted for securing, preferably by welding, to the backing member such that the body portion of said saddle bracket, together with the shaped front surface of the backing member, define a substantially cylindrical guide channel for the locking bar.

It will be appreciated that, with such an arrangement, the plate like portion of the backing members can be fully welded to the door or part welded and part sealed to the door so that the underlying part of the door is totally excluded from contact with the atmosphere. Thus the door and attached backing members can be treated as required either before or after the fitting thereto of the locking bar and the saddle brackets.

The location of the region of attachment of the saddle bracket to the backing member at a position remote from the door means that said bracket can, if desired; be welded to the backing member subsequent to treatment of the door and backing member without damaging the paint previously applied to the door.

In a preferred arrangment, the edge regions of the saddle bracket are each of a reflex nature to be of generally inverted U-shape in transverse section, said edge regions engaging the front surface of the backing member, the backing member further including opposed upstanding sidewalls located laterally outwardly of the edge regions of the saddle bracket, the free edges of the bracket lying closely adjacent the upper ends of the associated sidewalls of the backing member and being secured thereto.

With such an arrangement, the saddle bracket is secured to the backing member by longitudinal welds between the edges of the saddle bracket and upper surfaces of said sidewalls. The provision of the reflex edge regions to the saddle bracket and the upstanding sidewalls on the backing member further remove the welding region from the door, while linear welds of this nature can be readily ground away to enable replacement of damaged locking bars without any substantial damage to the components of the location means which can therefore be re-used.

In one embodiment of the invention, the backing member is of unitary construction and has three parallel, longitudinal grooves formed in the front surface thereof, the central groove receiving therein part of the circular section of the locking bar of the assembly and the outer grooves each receiving therein an associated reflex edge region of the saddle bracket.

In an alternative embodiment of the invention, the backing member includes a central bush located on the front surface of said substantially plate-like portion and having a surface shaped to receive therein part of the circular section of the locking bar of the assembly, the edge regions of the saddle bracket engaging the front surface of said substantially plate like portion one to each side of said central bush.

DESCRIPTION OF THE PREFERRED EMBODIMENTS

Figure 1:
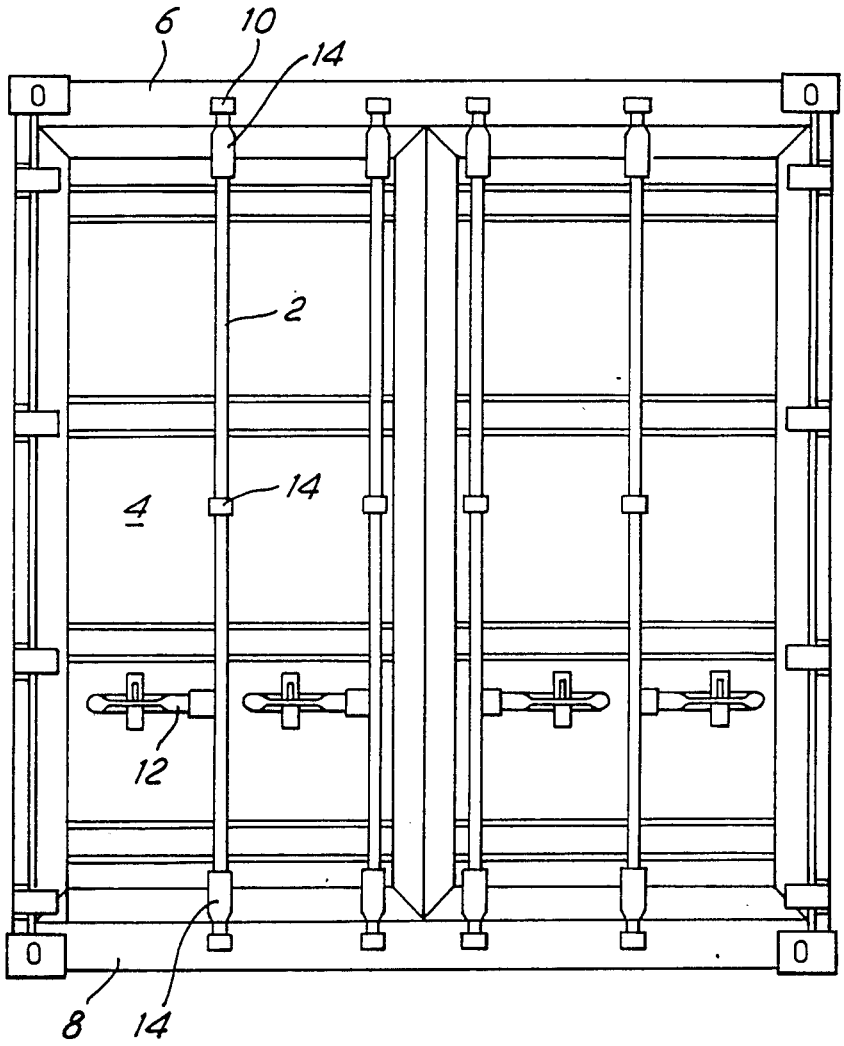
FIG. 1 is an end view of a conventional I.S.O. freight container showing door locking assemblies of the type described.

Referring to the drawings, FIG. 1 shows a conventional I.S.O. freight container provided with door locking assemblies of the type described. Each such assembly includes a locking bar 2 extending longitudinally of an associated door 4 between upper and lower transverse frame members 6,8 of the container. The upper and lower ends of the bar carry cams adapted to co-operate with abutments means 10 secured to the frame members 6,8 whereby, on rotation of the bar 2 by means of an attached handle 12, the cams and abutment means 10 co-operate to secure the door 4 in the frame.

The bar is rotatable within location means 14 each comprising a bracket of substantially U-shape in transverse section the edges of which are welded to the outer surface of the door 4 with the consequential disadvantages detailed above that the areas of the door 4 behind said brackets 14 cannot be treated against corrosion and the like.

The location means according to the invention overcome this problem and serve to replace the location means 14 of FIG. 1, with the other components of the door locking assembly remaining as shown in FIG. 1.

Figure 2:
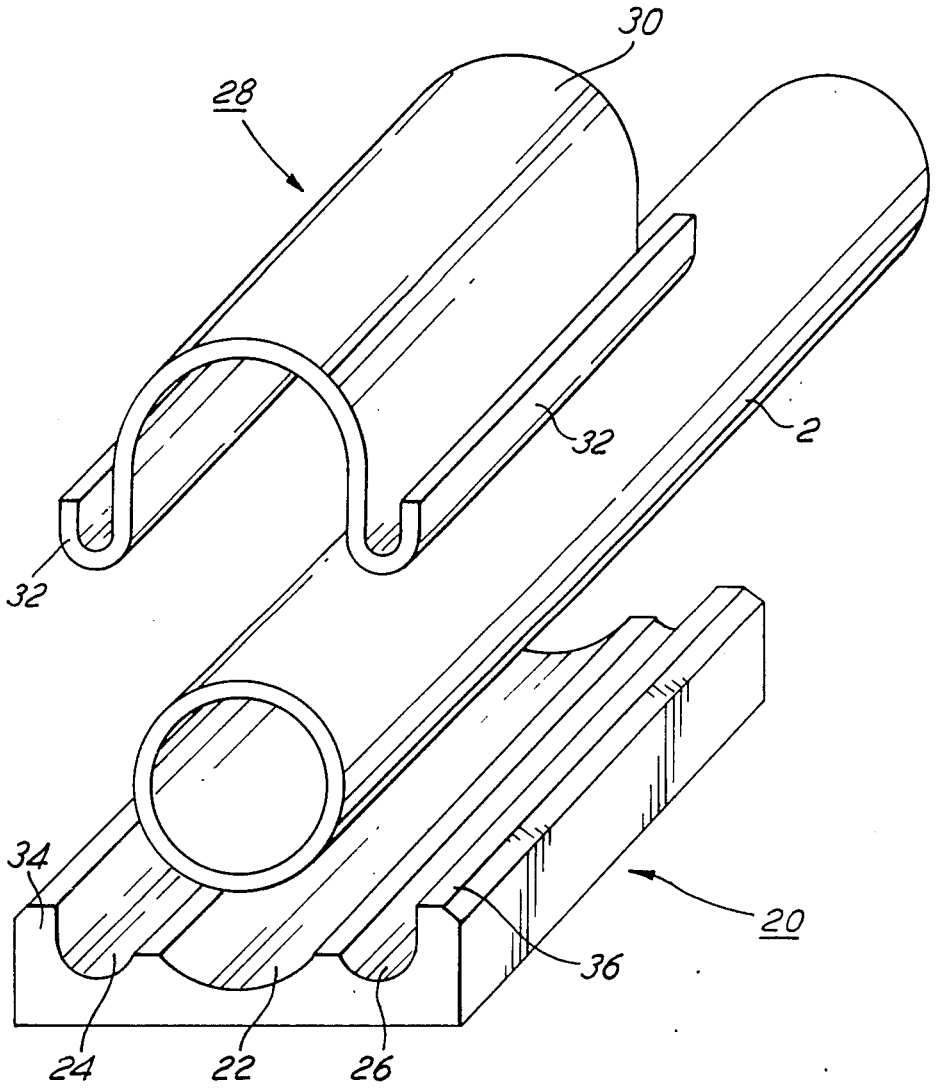
FIG. 2 is an exploded view of first location means according to the invention.
Figure 3:
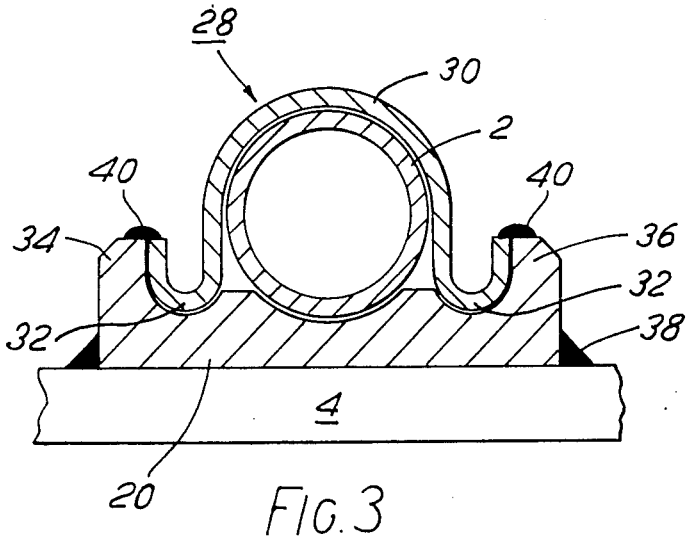
FIG. 3 is a transverse section through the location means of FIG. 2 in the assembled condition.

Referring to FIGS. 2 and 3, each locations means comprises a backing member in the form of a plate 20 having a flat rear surface and a front surface in which are formed three parallel grooves 22,24,26 each of part-circular shape in transverse section for reasons which will become apparent, the central groove 22 being shaped to receive therein part of the surface of a locking bar 2.

Each location means further comprises a saddle bracket indicated generally at 28 and including a body portion 30 of substantially U-shape in transverse section. The free edges of the body portion 30 are bent outwardly and upwardly relative to the adjacent wall of the body portion to define reflex edge regions 32 to the saddle bracket 28, each of which edge regions is of generally inverted U-shape in transverse section.

The grooves 24,26 in the backing plate 20 are each shaped and positioned to receive therein one of the reflex edge regions 32 of the saddle bracket 28, the outermost wall of each groove 24,26 being extended upwardly to define opposed upstanding sidewalls 34,36 to the backing plate 20 which terminate level with the edges of the edge regions 32 of the saddle bracket 28 when said bracket is located in position on the backing plate 20 as seen in FIG. 3.

As can be seen from FIG. 3 the backing plate 20 together with the saddle bracket 28 positioned thereon define between them a substantially cylindrical guide channel for the locking bar 2.

The described location means are attached to a door 4 as follows. The backing plate 20 is first of all welded to the door, the weld 38 extending all the way round the plate 20. Alternatively said weld 38 may extend part way only around the plate 20, the remainder of the periphery of said plate being sealed. In both cases the area of the door 4 behind the backing plate 20 is totally sealed from the atmosphere.

The door 4 and attached backing plates 20 can then be treated as desired for anti-corrosion purposes, there being no untreated areas left which could corrode. After treatment, the locking bars 2 are positioned to rest in the aligned grooves 22 in the associated backing plates 20 and the saddle brackets 28 are located on their associated backing plates 20. Each saddle bracket 28 is then secured to its backing plate 20 by linear welds 40 extending between the upstanding walls 34,36 of the plates 20 and the free edges of the reflex regions 32 of the saddle bracket 28.

It will be appreciated that said welds 40, being located remote from the surface of the door 4 by virtue of the provision of the walls 34,36 on the plate 20 and the reflex nature of the regions 32 of the bracket 28, do not result in any damage to the previously applied paintwork of the door 4.

In an alternative arrangement, treatment of the door 4 can be effected after the complete door locking assemblies have been secured to the door-i.e. after the brackets 28 have been welded to the plates 28.

The bars 2 are very prone to damage and it is often necessary to replace said bars. In such cases, the associated location means 14 of FIG. 1 had to be removed from the door 4 to enable replacement of the bars, and inevitably the brackets of such location means were damaged beyond repair and could not be used again.

The provision of the linear welds 40 in the location means of the invention enables ready replacement of the bars 2 without damage to the components of the location means. More particularly, the welds 40 can be ground away to break the bond between the components 20 and 28 whereby the bar 2 can be removed and replaced as necessary and the bracket 28 then re-welded to the plate 20. Again the remote position of the welds 40 from the door 4 enables such replacement to be effected without damage to the door 4.

Containers of the type to which the described door locking assemblies are to be applied must be capable of withstanding substantial forces tending to distort the cubic shape of the container. Accordingly, the brackets of the location means 14 of the known arrangements had to be of fairly substantial size whereby the welds between the brackets of said location means and the door 4 were capable of withstanding said forces.

With the location means according to the invention lateral loads applied to the container and tending to distort the container are transmitted directly to the peripheral frame of the container through the backing plates 20 whereby the size of the location means can be substantially reduced compared with the known arrangements. Consequently welding requirements and material are reduced enabling the components to be marketed at competitive prices.

Figure 4:
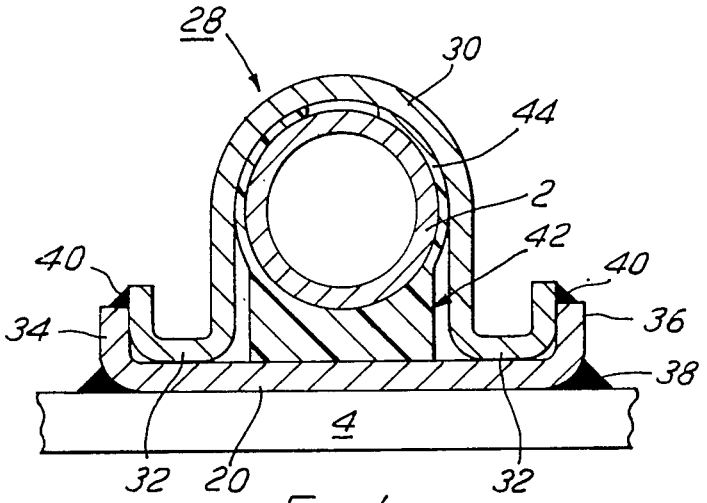
FIG. 4 is a transverse section through second location means according to the invention.

Referring to FIG. 4, there is shown an alternative location means according to the invention in which components equivalent to those of FIGS. 2 and 3 are similarly referenced.

More particularly, the backing member is pressed from flat steel plate 20 provided with upstanding sidewalls 34,36. Located centrally on the plate 20 is a separate plastics bush 42, for example of nylon, and including a hollow, part-cylindrical portion 44 adapted to receive therein and embrace the locking bar 2 as shown. Said portion 44 includes opposed end flanges (not shown) extending radially outwardly of the portion 44 and adapted to locate between them the body portion 30 of the saddle bracket 28 when said bracket is positioned for securing to the plate 20. In all other general respects, the location means of FIG. 4 are attached to a door 4 in the same manner as the location means of FIGS. 2 and 3.

Thus there are provided location means for door locking assemblies of freight containers which are such as to eliminate the presence of any untreated regions of the door with a consequential reduction in corrosion problems, which are such as to enable ready replacement of damaged locking bars without damage to the components of the location means with consequential reduction in repair costs, and which are such as to enable the location means to be of smaller, more compact size than heretofore with a consequential reduction in manufacturing costs.

What I claim and desire to secure by Letters Patent is:

1. Location means for a freight container door locking assembly having a locking bar of circular cross-section, the location means comprising a backing member including a substantially plate-like portion having a rear surface adapted to be secured against the surface of the door of the container, the locking member further including a front surface shaped to receive therein part of the cirular section of the locking bar of the assembly and a pair of opposed, upstanding sidewalls having upper ends thereto, and a saddle bracket having a body portion of substantially U-shape in transverse section and a pair of opposed reflex edge regions of generally U-shape in transverse section, the edge regions of the saddle bracket being located laterally within the upstanding sidewalls of the backing member to engage the front surface of the backing member such that the body portion of the saddle bracket, together with the shaped front surface of the backing member, define a substantially cylindrical guide channel for the locking bar, the free edges of the bracket lying closely adjacent the upper ends of the associated sidewalls of the backing member and being welded thereto at locations remote from the door.

2. Location means as claimed in claim 1 in which the backing member is of unitary construction, three parallel, longitudinal grooves being formed in the front surface thereof, the central groove receiving therein part of the circular section of the locking bar of the assembly and the outer grooves each receiving therein an associated reflex edge region of the saddle bracket.

3. Location means as claimed in claim 1 in which the backing member includes a central bush located on the front surface of said substantially plate-like portion and having a surface shaped to receive therein part of the circular section of the locking bar of the assembly, the edge regions of the saddle bracket engaging the front surface of said substantially plate-like portion one to each side of said central bush.

* * * * *